US006508751B1

(12) United States Patent
Weishew et al.

(10) Patent No.: US 6,508,751 B1
(45) **Date of Patent: *Jan. 21, 2003**

(54) METHOD AND APPARATUS FOR PREFORMING AND CREASING CONTAINER BOARD

(75) Inventors: Joseph John Weishew, Oreland, PA (US); Albert James Patragnoni, Marlton, NJ (US); Richard P. Target, Lower Gwynedd, PA (US)

(73) Assignee: Sun Source l LLC, Sparks, MD (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/928,611

(22) Filed: Sep. 12, 1997

(51) Int. Cl.[7] ..... B31B 1/25

(52) U.S. Cl. ..... 493/59; 493/68; 493/160; 493/355; 493/356; 493/399

(58) Field of Search ..... 493/58, 59, 60, 493/64, 68, 71, 72, 160, 240, 241, 245, 355, 356, 364, 395, 396, 397, 398, 399, 400, 401, 402, 403, 463

(56) References Cited

U.S. PATENT DOCUMENTS

| | | | | | |
|---|---|---|---|---|---|
| 1,000,139 | A | | 1/1911 | Wyman | |
| 1,302,831 | A | | 5/1919 | Naugler | |
| 1,494,604 | A | | 5/1924 | Jones | |
| 1,591,062 | A | | 7/1926 | Smith | |
| 1,600,396 | A | | 9/1926 | Campbell et al. | |
| 1,605,518 | A | | 11/1926 | Davis | |
| 1,687,683 | A | * | 10/1928 | Mogel | 493/403 |
| 1,737,553 | A | | 12/1929 | Andrews | |
| 1,828,234 | A | * | 10/1931 | Swift | 493/403 |
| 1,893,554 | A | | 1/1933 | Knowlton | |
| 1,941,484 | A | | 1/1934 | Nasmith | 93/58 |
| 1,959,424 | A | | 5/1934 | Hawkins | 164/61 |
| 2,117,460 | A | | 5/1938 | Staude | 93/52 |
| 2,176,147 | A | | 10/1939 | Palmer | 93/3 |
| 2,575,257 | A | | 11/1951 | Boulware | 154/53.5 |
| 2,657,044 | A | * | 10/1953 | Apgar | 493/403 |
| 2,765,716 | A | | 10/1956 | Andersson | 93/58 |
| 2,982,186 | A | | 5/1961 | McKeen | 93/1 |
| 3,163,095 | A | | 12/1964 | Sheeran | 93/58.3 |
| 3,314,339 | A | * | 4/1967 | Guffy | 493/403 |
| 3,318,206 | A | * | 5/1967 | Kuehn | 493/397 |
| 3,526,566 | A | | 9/1970 | McIlvain, Jr. et al. | 161/123 |
| 3,604,317 | A | | 9/1971 | Braun | 93/58 ST |
| 3,619,318 | A | | 11/1971 | Shultz | 156/215 |
| 3,735,674 | A | | 5/1973 | Haddock | 93/58 R |
| 3,786,708 | A | * | 1/1974 | Mumper | |
| 3,910,170 | A | * | 10/1975 | Boy | |
| 4,041,849 | A | * | 8/1977 | Tsukasaki | |
| 4,090,384 | A | * | 5/1978 | Wootten | |
| 4,170,674 | A | * | 10/1979 | Matsuki | |

(List continued on next page.)

OTHER PUBLICATIONS

The Langston Corporation's 3797 Saturn Pre–Creaser Assembly, Drawing No. 425675, which was known before the filing date of the present application.

The Langston Corporation's brochure for the Saturn III flexo folder gluer which was known before the filing date of the present application.

*Primary Examiner*—Eugene Kim
(74) *Attorney, Agent, or Firm*—William E. Mouzavires

(57) ABSTRACT

A method and apparatus for preparing container board having a corrugated medium and at least one liner formed thereon for folding which comprises a tool for displacing in a non-destructive manner the corrugated medium and the liner in a portion of the board to form a curved indentation therein. The device includes a separate tool for forming a line of weakness in the liner along the curved indentation portion of the board. This arrangement increases the dimensional accuracy of the container board by substantially eliminating the occurrences of "false" score lines or rolling scores.

8 Claims, 4 Drawing Sheets

U.S. PATENT DOCUMENTS 4,242,172 A * 12/1980 Fujii
4,254,692 A 3/1981 Sardella ..... 493/179
4,268,555 A * 5/1981 Kantz
4,286,006 A * 8/1981 Boelter
4,596,541 A * 6/1986 Ward
4,605,210 A * 8/1986 Hechler ..... 493/398
4,708,708 A 11/1987 Fries, Jr. ..... 493/357
4,711,797 A 12/1987 Niske ..... 428/35
4,784,269 A 11/1988 Griffith ..... 206/453
RE32,817 E 1/1989 Vossen ..... 493/1
4,816,015 A * 3/1989 Holder
4,854,927 A 8/1989 Reneau et al. ..... 493/27
4,946,430 A 8/1990 Kohmann ..... 493/58
5,002,524 A * 3/1991 Mills
5,169,651 A * 12/1992 Heiber ..... 493/403
5,207,632 A 5/1993 Brunlid ..... 493/355
5,215,516 A * 6/1993 Stutt ..... 493/365
5,250,018 A 10/1993 Chung et al. ..... 493/59
5,266,148 A * 11/1993 Keech
5,332,458 A * 7/1994 Wallick
5,356,364 A * 10/1994 Weith
5,393,295 A * 2/1995 Knecht ..... 493/403
5,429,577 A * 7/1995 Simpson ..... 493/354
5,466,211 A 11/1995 Komarek et al. ..... 493/355
5,582,571 A * 12/1996 Simpson
5,641,551 A * 6/1997 Simpson
5,690,601 A * 11/1997 Cummings

* cited by examiner

METHOD AND APPARATUS FOR PREFORMING AND CREASING CONTAINER BOARD

FIELD OF THE INVENTION

The invention relates generally to a method and device for preparing container board for folding. In particular, the invention concerns providing a device for displacing in a non-destructive manner the corrugated material and the liner in a portion of the container board to form a curved indentation therein and a separate creasing tool for forming a line of weakness in the liner along the indentation.

BACKGROUND OF THE INVENTION

Container board boxes are widely used for the packaging of multiple items, such as bottles, and heavier items, such as refrigerators, televisions, and other consumer goods. Container board boxes are commonly fabricated from a web of container board which has been slotted, creased, and cut into blanks. The blanks are then folded on the crease line and glued to form flattened box blanks. The box blanks are then formed into the final box shape by the packager to receive products therein.

Modern value-added package design and automated filling equipment demand that the boxes be dimensionally accurate. One of the main factors affecting the dimensional accuracy of container board boxes is the size of the box panels. Presently, box panel size is determined by mechanically scoring a crease line into the container board.

One such existing creasing device 110 is shown in FIG. 1 and includes a pair of shafts 112. A female ring 114 is mounted on a hub 116 located on one of the creasing/scoring shafts 112. A male ring 118 is mounted to a hub 120 located on the other creasing/scoring shaft 112. The female ring 114 and the male ring 118 form a nip for receiving a web of container board 124. The male ring 118 includes a male scoring bead 122 for compressing the container board 124 into the female ring 114.

The container board 124 comprises a corrugated medium 126 interposed between an inner liner board 128 and an outer liner board 130. The male scoring bead 122 forms a crease line 132 (best seen in FIG. 2) in the inner liner 128 and the corrugated medium 126 at the nip between the male and female rings 114 and 118. The crease line 132 separates the container board 124 into side-by-side panels, such as an inboard panel 134 and an outboard panel 136.

There is a critical value of nip pressure that must be maintained in order to produce a useful crease line 132. Too little nip pressure produces an undefined crease line, whereas too much pressure tends to cut or crack the liner paper of the liner boards 128 and 130.

After the crease line 132 is formed, the outboard panel 136 is urged down around the crease line 132 either by a rotating folding rod 138 or moving belt (not shown). By nature, folding a container board sheet requires the outer liner board 130 to stretch, the inner liner board 128 to contract, and the corrugating medium 126 to compress.

Due to the many variables encountered in the manufacture of container board boxes, such as liner and medium paper weights, moisture content, and recycled grades, the flutes of the corrugated medium 126 adjacent to the crease line 132 may be weaker than the crease line 132 itself and frequently causes the outboard panel 136 to fold about a "false" score line 140. These false score lines 140, also known as "rolling scores", change the dimension of the panels 134 and 136 on either side of the false score 140, producing a container board box that is dimensionally not within specification. Since the dimensions of the panels are different from the design dimensions, the container blank forms a parallelogram when folded and not the intended rectangular shape. The false score lines 140 can occur at anytime during a production run of boxes and are very difficult to eliminate with normal machine set-up functions.

SUMMARY OF THE INVENTION

The present invention substantially eliminates the occurrences of "rolling scores" by displacing paper in a controlled non-destructive manner before the container board is creased to produce the necessary clearances required to permit accurate bending of the panels around the "true" crease line.

The present invention includes a device for displacing in a non-destructive manner the corrugated medium and at least one of the liners in a portion of the board to form a curved indentation therein. A crease or line of weakness is then formed in the liner along the curved indentation of the board.

It is contemplated that the device can comprise a rotatably supported backing ring and a cooperating rotatably supported forming ring with a peripheral face having a curved profile. The container board is received between the nip formed between the peripheral faces of the forming and the backing rings. The curved profile of the forming ring cooperates with the peripheral face of the backing ring to displace the corrugated medium and at least one of the liners to form the curved indentation therein.

It is further contemplated that the device imparts to the container board a curved indentation having a parabolic shape.

In one form of the invention the profile of the peripheral face of the forming ring has a radius of about six inches (15.24 cm) and a width of about one inch (2.54 cm). The peripheral face of the backing ring has a substantially flat profile and is at least about two inches (5.08 cm) wide.

Additional features and advantages of the invention will become apparent to those skilled in the art upon consideration of the following detailed description of the preferred embodiment as amplifying the best mode of carrying out the invention as presently perceived. The detailed description particularly refers to the accompanying drawings.

DETAILED DESCRIPTION OF THE PREFERRED EMBODIMENT

Figure 1:
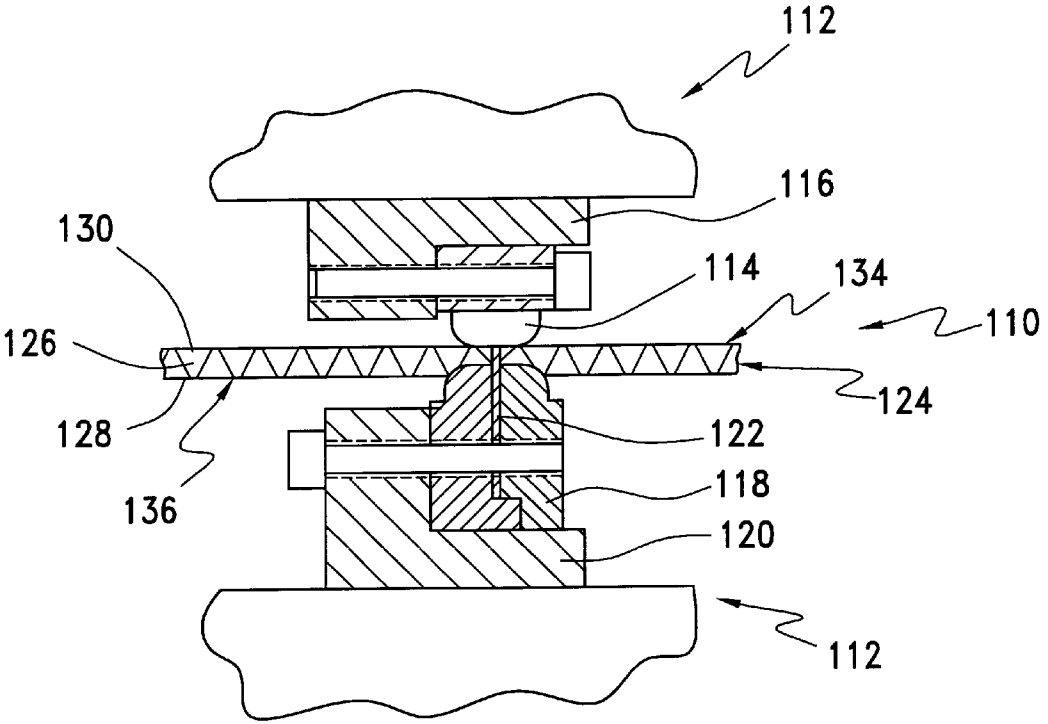
FIG. 1 PRIOR ART
FIG. 1 shows a prior art creasing device for forming a line of weakness in a container board.
Figure 2:
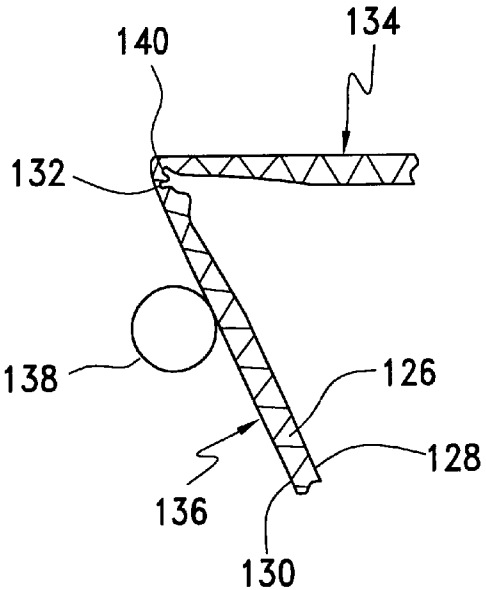
FIG. 2 PRIOR ART
FIG. 2 shows,the prior art creased container board being folded about a false score line.
Figure 3:
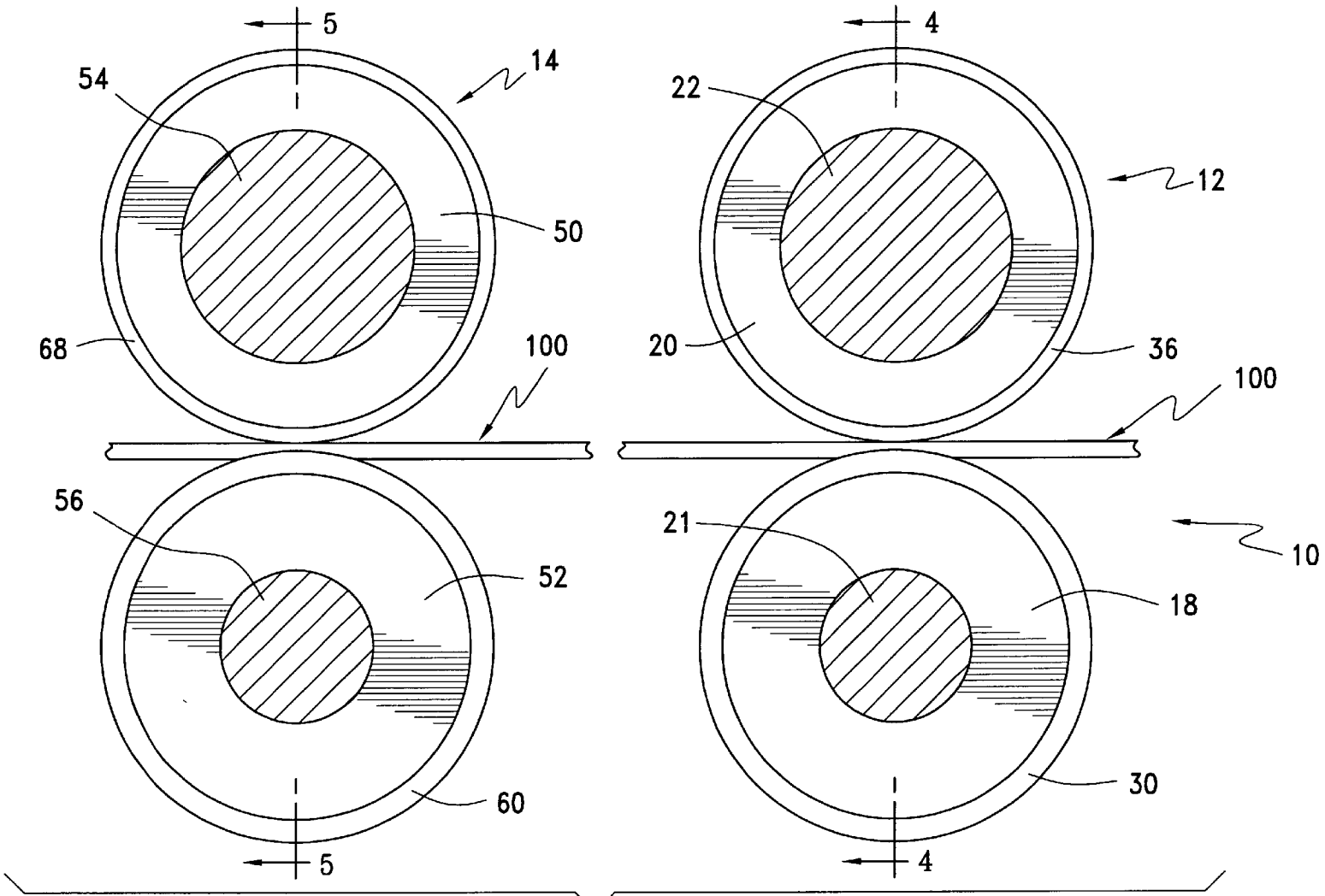
FIG. 3 shows a device for preparing a container board blank or web for folding in accordance with one form of the present invention.
Figure 4:
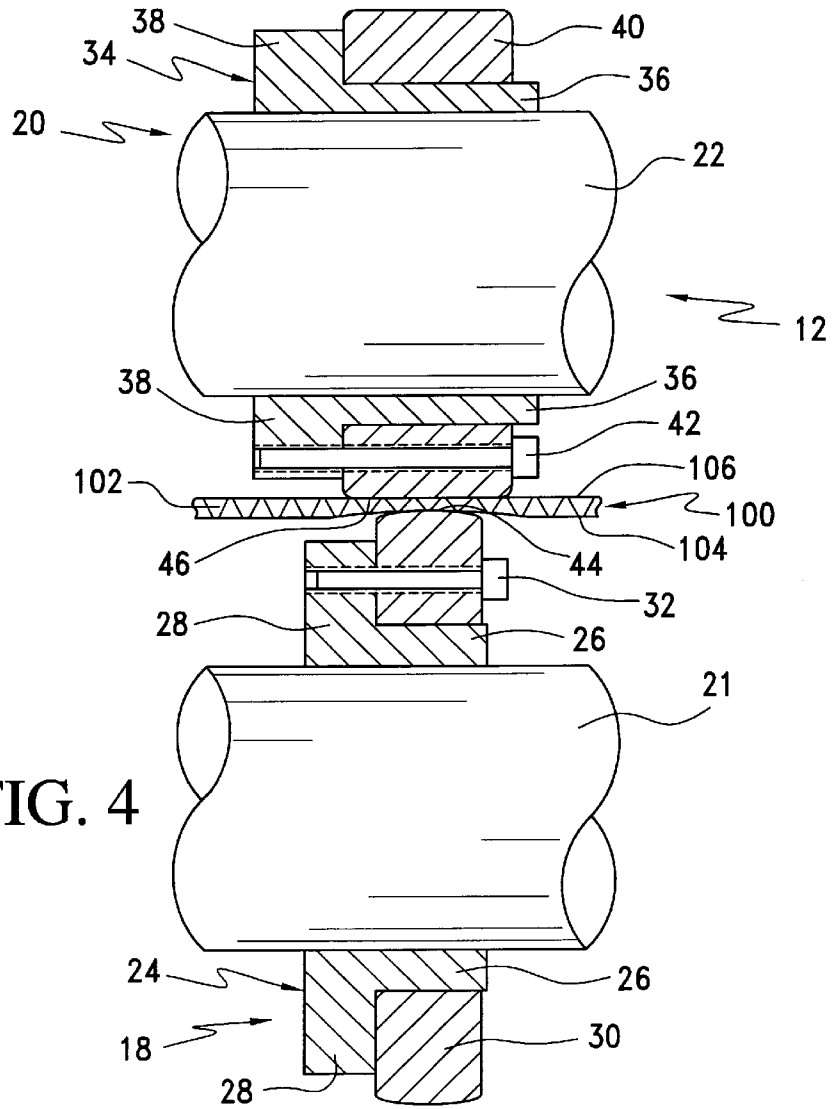
FIG. 4 shows a partial cross-sectional view of the material displacing device of the present invention taken along line 44 of FIG. 3.
Figure 5:
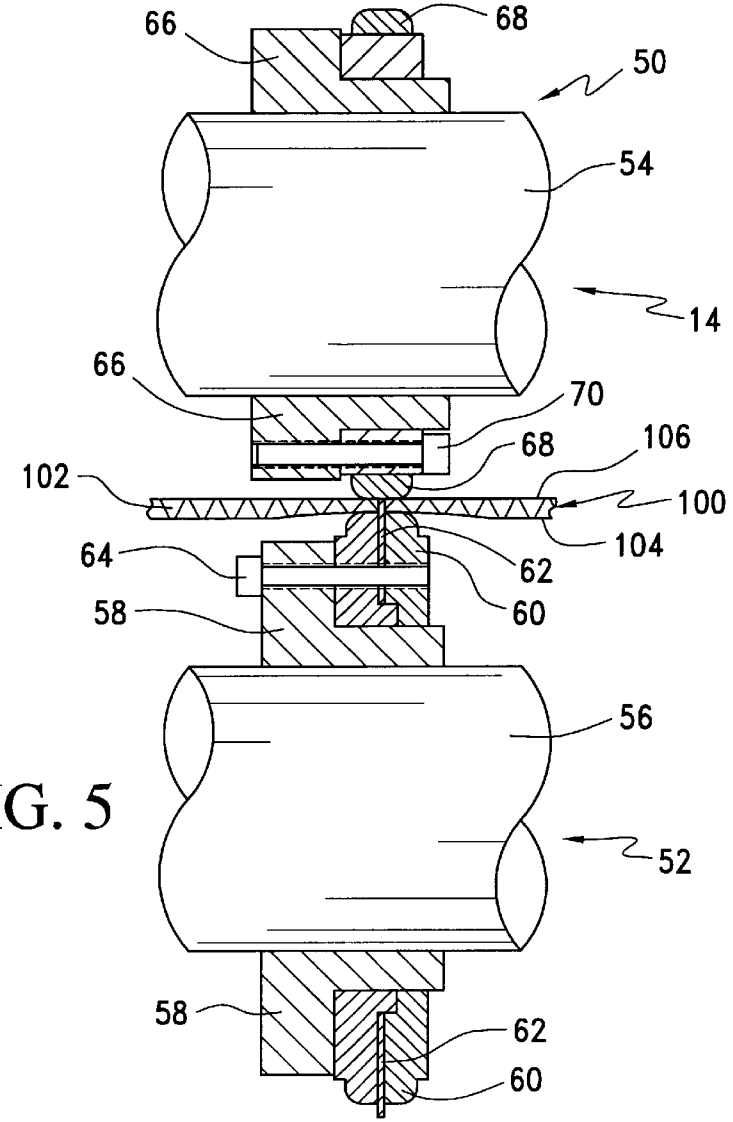
FIG. 5 shows a partial cross-sectional view of the creasing device of the present invention taken along line 5—5 of FIG. 3.
Figure 6:
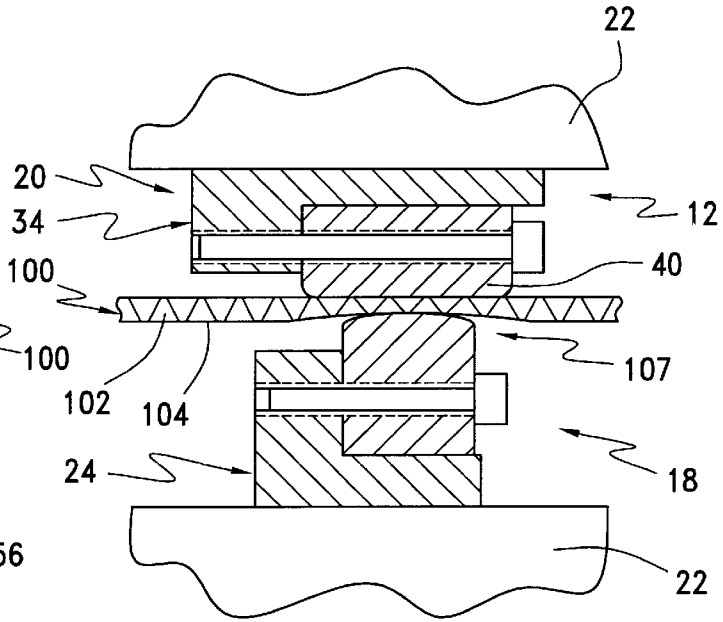
FIG. 6 shows a container board being compressed by the material displacing tool in accordance with the present invention.
Figure 7:
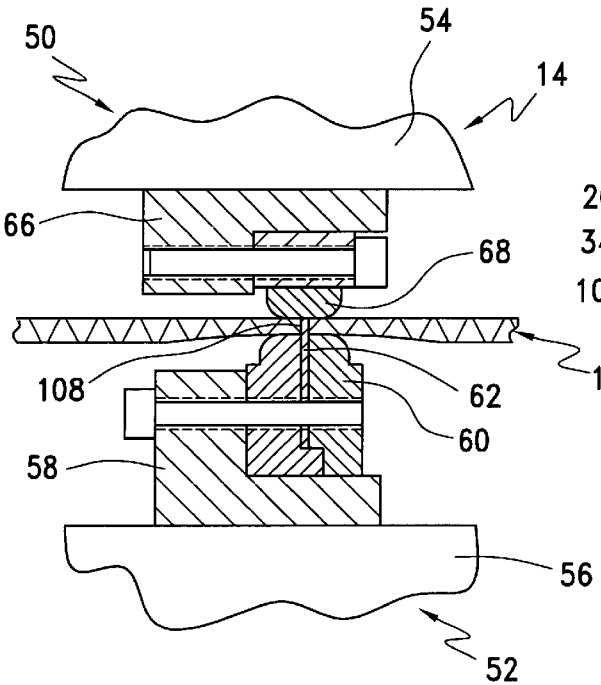
FIG. 7 shows a container board being creased by the creasing tool in accordance with the present invention.

Referring now to the drawings, FIGS. 3 through 5 illustrate a device 10 for preparing container board 100 for folding. The container board 100 typically comprises a corrugated medium 102 interposed between an inner liner board 104 and an outer liner board 106.

The device 10 includes a material displacing tool 12 which receives the container board 100 and displaces the corrugating medium 102 and at least the inner liner board 104 to form a curved indentation therein. The container board 100 is then transported to a creasing device 14 which forms a line of weakness or crease in the curved indentation portion of the container board 100 formed by the material displacing device 12. The container board 100 is then transported to a folding device 16 (shown in FIG. 8) for folding the container board 100 into a box blank. U.S. Pat. No. 4,254,692 entitled *Helical Folder For Paperboard Blanks* shows such a folding device for folding container board blanks to form boxes, and is hereby incorporated by reference herein.

Referring now to FIGS. 3 and 4, the material displacing device 12 comprises a forming tool 18 and a cooperating backing tool 20. The forming tool 18 and backing tool 20 are detachably secured to a respective rotatable shaft 21 and 22. Each shaft 21 and 22 may be supported in any suitable bearing, and driven by any suitable driving device.

The forming tool 18 includes a collar 24 which is detachably and adjustably secured to the shaft 21. The collar 24 comprises a hub portion 26 and a radially extending annular body portion 28. A forming ring 30 is mounted on the hub portion 26 of the collar 24. The forming ring 30 is secured to the annular body portion 28 of the collar 24 by a suitable fastening device, such as a set bolt 32. As best seen in FIG. 4, the radial extent of the forming ring 30 is greater than the radial extent of the annular body portion 28 of the collar 24. The forming ring 30 is preferably fabricated from a hard, durable material, such as steel.

The peripheral face 44 of the forming ring 30 has a curved profile for imparting a parabolically shaped curved indentation to the container board 100. It has been found that the radius of curvature of the peripheral face 44 should be about 6 inches to impart a suitable parabolically curved shape to the container board 100 and to reduce any stress concentrations imparted to the container board 124 which may cut the liner during the material displacing process.

The backing tool 20 includes a collar 34 which is detachably and adjustably secured to the shaft 22. The collar 34 comprises a hub portion 36 and a radially extending annular body portion 38. A backing ring 40 is mounted on the hub portion 38 of the collar 34. The backing ring 40 is secured to the annular body portion 38 of the collar 34 by a suitable fastening device, such as set bolt 42. As best seen in FIG. 4, the radial extent of the backing ring 40 is greater than the radial extent of the annular body portion 38 of the collar 34. The forming ring 30 and the backing ring 40 cooperate to form a nip for receiving the web or blank of container board 100. The backing ring 40 is fabricated from any suitable resilient, durable material, such as urethane or steel.

The peripheral face 46 of the backing ring 40 has a substantially planar profile which serves as a support for the forming ring 30. In addition, the width of the backing ring 40 is contemplated to be greater than the width of the forming ring 30 in order to support the container board 100 during the material displacing process, allowing the forming tool 30 to form the gradually extending parabolically curved indentation therein. It has been found that a suitable parabolic curve is produced when the width of the forming ring 30 is about one inch (2.54 cm) and the width of the backing ring is at least about two inches (5.08 cm).

Referring now to FIGS. 3 and 5, the creasing device 14, which is substantially similar to the creasing device 110, includes a creasing tool 52 and a cooperating supporting tool 50. The creasing tool 52 and supporting tool 50 are detachably secured to a respective rotatable shaft 56 and 54.

The creasing tool 52 includes a collar 58 which is detachably and adjustably secured to the shaft 56. A creasing ring 60 is mounted on the hub portion of the collar 58. The creasing ring 60 includes a male scoring bead 62 interposed between the split halves of the creasing ring 60. The creasing ring 60 is secured to the annular body portion of the collar 58 by a suitable fastening device, such as a set bolt 64.

The supporting tool 50 includes a collar 66 which is detachably and adjustably secured to the shaft 54. A supporting ring 68 is mounted on the hub portion of the collar 66. The supporting ring 68 is secured to the annular body portion of the collar 66 by a suitable fastening device, such as set bolt 70.

The creasing ring 60 and the supporting ring 68 cooperate to form a nip for receiving the web or blank of container board 100.

In operation, a container board web or blank 100 is fed into the material displacing device 12. The container board 100 is received within the nip formed between the forming ring 30 and the backing ring 40. The rotating forming ring 30 compresses the container board 100 into the rotating backing ring 40. The forming ring 30 displaces in a non-destructive manner the corrugated medium 102 and the inner liner 104 in a portion of the container board 100 to form a curved parabolic indentation 107 thereon. After passing through the material displacing device 12, the container board 100 enters the creasing device 14.

The container board 100 is received in the nip formed by the creasing ring 60 and the supporting ring 68. The male scoring bead 62 forms a line of weakness or crease line 108 (best seen in FIG. 8) in the inner liner 104 and the corrugated medium 106 at the nip between the creasing and supporting rings 60 and 68. The crease line 108 separates the container board 100 into side-by-side panels, such as an inboard panel 101 and an outboard panel 103.

Figure 8:
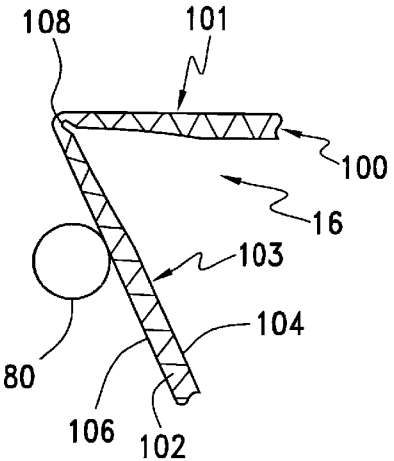
FIG 8 shows the container board being folded about the score line by a folding tool in accordance with the present invention.

As shown in FIG. 8, after the crease line 108 is formed in the container board 100, the outboard panel 103 is urged down around the crease line 108 by a folding rod 80 or moving belt (not shown).

The material displacing device 12 ensures that the flutes of the corrugated medium 102 adjacent to the crease line 108 are stronger than the crease line 108 itself and prevent the formation of "rolling scores" which would otherwise change the dimensions of the panels 101 and 103 on either side of the rolling score.

It has been found that about a 1.25 inch (3.18 cm) parabolic curve formed in the container board 100 is sufficient to prevent the formation of rolling scores. It is believed that by controllably displacing the liner and corrugated material of the container board prior to forming the line of weakness therein, permits the crease line to be formed with greater pressure which might otherwise cut the inner liner of an "un-displaced" container board.

The present invention may be embodied in other specific forms without departing from the spirit or essential attributes thereof and, accordingly, reference should be made to the appended claims, rather than to the foregoing specification, as indicating the scope of the invention.

What is claimed is:

1. A device for folding corrugated container board having a corrugated medium and a liner formed thereon comprising:

a tool for displacing the liner inwardly with respect to the board and compressing the corrugated medium in portion of the board to reduce the thickness of the board and to form a gradually curved indentation therein without adversely affecting the integrity of the corrugated medium;

a separate tool for forming a line of weakness in the liner along the curved portion of the board, said line of weakness separating the board into side-by-side panels;

a separate tool for urging one of said panels down around said line of weakness to fold said board along said line of weakness; and wherein the displacing and compressing tool comprises a rotatably supported backing ring with a peripheral face having a substantially flat profile and a cooperating rotatably supported forming ring with a peripheral face having a gradually curved profile of a width less than the width of said flat profile, a nip formed between the peripheral faces of the forming and backing rings for receiving the container board, wherein the curved profile of the forming ring cooperates with the peripheral face of the backing ring to displace the liner and compress the corrugated medium to form the curved indentation in the board and to reduce the thickness of the board.

2. The device according to claim 1, wherein the material displacing tool forms a curved indentation having a parabolic shape in the liner.

3. The device according to claim 2, wherein the curved profile of the peripheral face of the backing ring has a radius of about six inches.

4. The device according to claim 2, wherein the peripheral face of the forming ring is at least about two inches wide.

5. A method of folding corrugated container board comprising the steps of:

providing a container board having a corrugated medium and a liner formed thereon;

providing in a folding device a tool having a rotatably supported backing ring with a peripheral face having a substantially flat profile and a cooperating rotatably supported forming ring with a peripheral face having a gradually curved profile with a width less than the width of said flat profile, a nip formed between the peripheral faces of the forming and backing rings;

receiving the container board at the nip and displacing the liner inwardly with respect to the board and compressing the corrugated medium in a portion of the board to reduce the thickness of the board and to form a gradually curved indentation in the board without adversely affecting the integrity of the corrugated medium;

providing in the folding device a separate creasing tool;

forming a line of weakness with the creasing tool in the liner along the curved indentation of the board, the line of weakness separating the board into side-by-side panels;

providing in the folding device a separate folding tool; and urging one of the panels down around the line of weakness with the folding tool to fold the board along the line of weakness.

6. A method of preparing container board according to claim

7. A method of preparing a container board according to claim 5, wherein the line of weakness is a crease or perforated crease.

8. A device for folding corrugated container board having a corrugated medium between an inner liner and an outer liner comprising:

a tool for displacing the inner liner inwardly with respect to the board and compressing the corrugated medium in a portion of the board to reduce the thickness of the board and to form a gradually curved indentation therein without adversely affecting the integrity of the corrugated medium and without affecting the outer liner, the displacing tool comprising a first shaft, a backing ring supported on the first shaft with a peripheral face being at least two inches wide and having a substantially flat profile, a second shaft, a forming ring supported on the second shaft with a peripheral face having a gradually curved parabolic profile with a width of about one inch and with a radius of about six inches, a nip formed between the peripheral faces of the forming and backing rings for receiving the container board;

a separate creasing tool for forming a line of weakness in the inner liner along the curved portion of the board, said line of weakness separating the board into side-by-side panels; and a separate folding tool for urging one of said panels down around said line of weakness to fold said board along said line of weakness.

* * * * *